US012590395B2

(12) United States Patent
Seo et al.

(10) Patent No.: US 12,590,395 B2
(45) Date of Patent: Mar. 31, 2026

(54) WASHING MACHINE APPLIANCE TURBIDITY DETECTION AND EVALUATION

(71) Applicant: Haier US Appliance Solutions, Inc., Wilmington, DE (US)

(72) Inventors: Wonmyung Seo, Seongnam (KR); Junho Kang, Seongnam (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 192 days.

(21) Appl. No.: 18/170,332

(22) Filed: Feb. 16, 2023

(65) Prior Publication Data

US 2024/0279862 A1 Aug. 22, 2024

(51) Int. Cl.

| | |
|---|---|
| ***D06F 34/22*** | (2020.01) |
| ***D06F 103/16*** | (2020.01) |
| ***D06F 103/20*** | (2020.01) |
| ***D06F 105/58*** | (2020.01) |

(52) U.S. Cl.

CPC ..... *D06F 34/22* (2020.02); *D06F 2103/16* (2020.02); *D06F 2103/20* (2020.02); *D06F 2105/58* (2020.02)

(58) Field of Classification Search

None

See application file for complete search history.

(56) References Cited

U.S. PATENT DOCUMENTS

| | | | | |
|---|---|---|---|---|
| 5,889,192 | A | 3/1999 | Engel | |
| 2019/0269294 | A1* | 9/2019 | Wecker | D06F 34/24 |
| 2021/0189627 | A1* | 6/2021 | Cha | G06N 3/088 |

FOREIGN PATENT DOCUMENTS

| | | | |
|---|---|---|---|
| CN | 100389318 | C | 5/2008 |
| CN | 205223646 | U | 5/2016 |
| KR | 20100031903 | A | 3/2010 |

* cited by examiner

*Primary Examiner* — Kaj K Olsen
*Assistant Examiner* — Pradhuman Parihar
(74) *Attorney, Agent, or Firm* — Dority & Manning, P.A.

(57) ABSTRACT

A washing machine appliance includes a cabinet with a wash tub positioned within the cabinet and a first temperature sensor disposed at the wash tub. The washing machine appliance also includes a turbidity sensor, a conductivity sensor, and a second temperature sensor disposed in the cabinet. The washing machine appliance further includes a controller in signal communication with the first temperature sensor, the turbidity sensor, the conductivity sensor and the second temperature sensor. The controller may be configured for, or a method of operating the washing machine appliance may include, recording a turbidity temperature measurement from the turbidity sensor, a first temperature measurement from the first temperature sensor, and a second temperature measurement from the second temperature sensor, comparing the first temperature measurement and the second temperature measurement, and evaluating the turbidity measurement based on the comparison of the first temperature measurement and the second temperature measurement.

18 Claims, 3 Drawing Sheets

WASHING MACHINE APPLIANCE TURBIDITY DETECTION AND EVALUATION

FIELD OF THE INVENTION

The present subject matter relates generally to systems and methods for measuring, e.g., detecting, sensing, etc., fluid properties, such as turbidity, in a washing machine appliance, and to systems and methods for evaluating such measurements.

BACKGROUND OF THE INVENTION

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element may rotate at various speeds to agitate articles within the wash chamber, to wring wash fluid from articles within the wash chamber, etc.

Washing machine appliances may operate in numerous cycles. For example, the typical washing machine appliance may be operable in various wash cycles, rinse cycles, drain cycles, and spin cycles. In the wash cycle, the wash fluid is directed into the wash tub and onto articles within the wash chamber of the basket. The rinse cycle includes rinsing the articles in the wash tub, e.g., with fresh water. The drain cycle is used in between different cycles to remove, e.g., drain, the wash fluid from the wash tub. In each of the cycles, fluid may be present in the tub of the washing machine appliance, and proper operation of the washing machine may rely upon accurately detecting qualities of the fluid in the tub, such as turbidity, temperature, etc.

Accordingly, washing machine appliances may include one or more fluid sensors, such as temperature sensors, conductivity sensors, and/or turbidity sensors, etc. Such washing machine appliances may also include features for or may be configured for error detection to determine or evaluate status of the sensor(s). Conventional error detection may be limited to detecting whether or not a signal is received from the sensor(s). In some cases, however, a signal or signals may be provided by the sensors(s), thus passing the fault check, but the readings from the sensor(s) may nevertheless be inaccurate, which may result in undesirable or inefficient operation of the washing machine appliance based on the inaccurate sensor readings. Accordingly, systems and methods for improved evaluation, e.g., error detection, of washing machine appliance sensors and measurements produced by such sensors is desired in the art.

BRIEF DESCRIPTION OF THE INVENTION

Aspects and advantages of the invention will be set forth in part in the following description, or may be apparent from the description, or may be learned through practice of the invention.

In one example embodiment, a washing machine appliance is provided. The washing machine appliance includes a cabinet with a wash tub positioned within the cabinet and a wash basket rotatably mounted within the wash tub. The wash basket is accessible through an opening in the cabinet. The washing machine appliance also includes a first temperature sensor disposed at the wash tub. A turbidity sensor, a conductivity sensor, and a second temperature sensor are disposed in the cabinet. The washing machine appliance further includes a controller in signal communication with the first temperature sensor, the turbidity sensor, the conductivity sensor, and the second temperature sensor. The controller is configured to record a turbidity measurement from the turbidity sensor, a first temperature measurement from the first temperature sensor, and a second temperature measurement from the second temperature sensor. The controller is also configured to compare the first temperature measurement and the second temperature measurement and to evaluate the recorded turbidity measurement based on the comparison of the first temperature measurement and the second temperature measurement.

In another example embodiment, a method of operating a washing machine appliance is provided. The washing machine appliance includes a cabinet with a wash tub positioned within the cabinet and a wash basket rotatably mounted within the wash tub. The wash basket is accessible through an opening in the cabinet. The washing machine appliance also includes a first temperature sensor disposed at the wash tub. A turbidity sensor, a conductivity sensor, and a second temperature sensor are disposed in the cabinet. The washing machine appliance further includes a controller in signal communication with the first temperature sensor, the turbidity sensor, the conductivity sensor, and the second temperature sensor. The method includes recording, at the controller, a turbidity temperature measurement from the turbidity sensor, a first temperature measurement from the first temperature sensor, and a second temperature measurement from the second temperature sensor. The method also includes comparing, by the controller, the first temperature measurement and the second temperature measurement and evaluating, by the controller, the recorded turbidity measurement based on the comparison of the first temperature measurement and the second temperature measurement.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
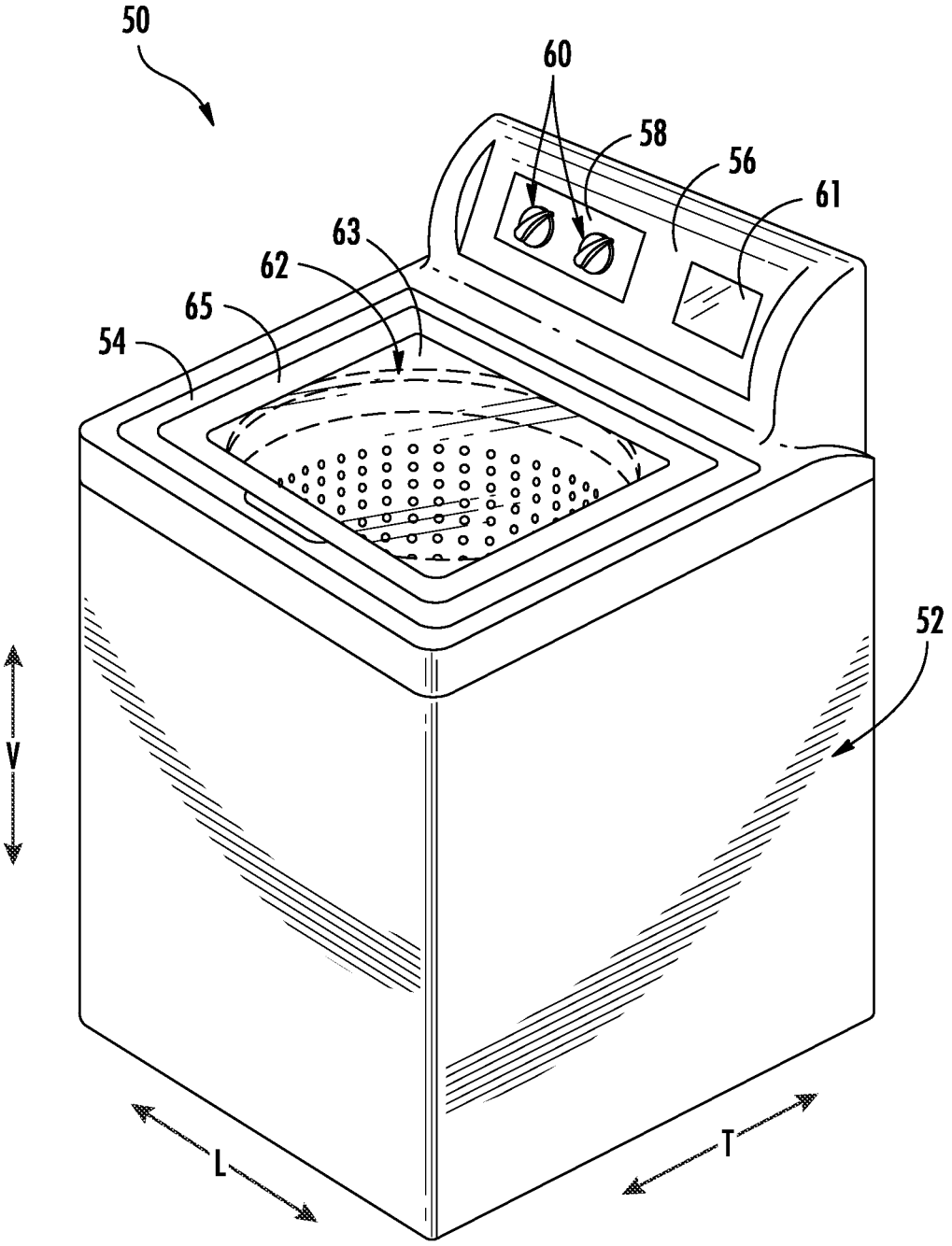
FIG. 1 provides a perspective view of a washing machine appliance according to example embodiments of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The phrase "in one embodiment," does not necessarily refer to the same embodiment, although it may. The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
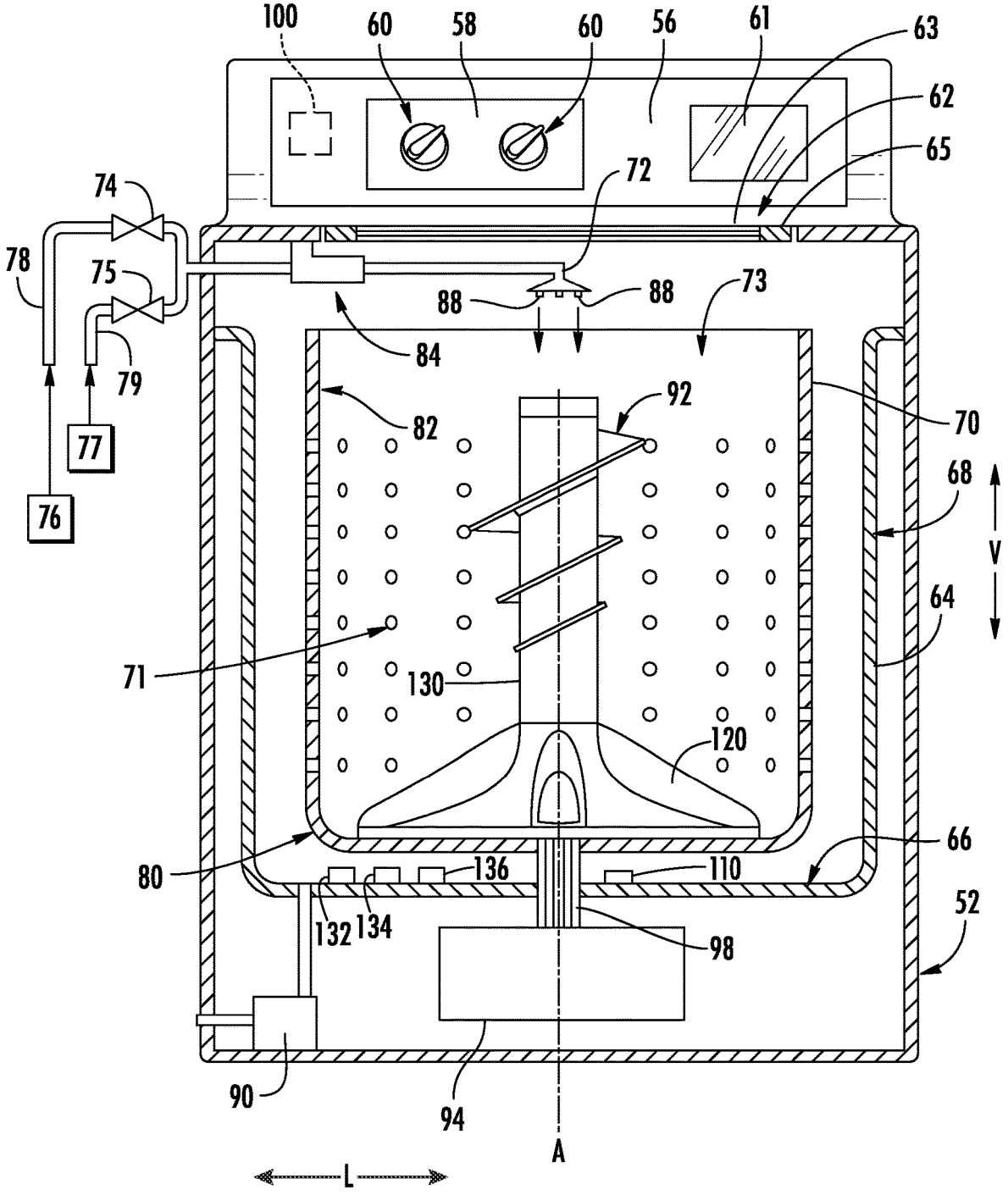
FIG. 2 provides a sectional view of the example washing machine appliance of FIG. 1.

Turning now to the figures, FIGS. 1 and 2 provide views of a washing machine appliance 50 according to one or more example embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system. Washing machine appliance 50 may include a cabinet 52 and a cover 54. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one example embodiment, a display 61 may indicate selected features, a countdown timer, or other items of interest to machine users. It should be appreciated, however, that in other example embodiments, the control panel 58, input selectors 60, and display 61, may have any other suitable configuration. For example, in other example embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a wash tub, 64 located within cabinet 52 and a closed position (FIG. 1) forming an enclosure over tub 64. Lid 62 in the illustrated example embodiment includes a transparent panel 63, which may be formed of, for example, glass, plastic, or any other suitable material. The transparency of the panel 63 allows users to see through the panel 63, and into the tub 64 when the lid 62 is in the closed position. In some example embodiments, the panel 63 itself can generally form the lid 62. In other example embodiments, the lid 62 includes the panel 63 and a frame 65 surrounding and encasing the panel 63. Alternatively, panel 63 need not be transparent, e.g., the panel 63 may be translucent or opaque.

As may be seen in FIG. 2, tub 64 includes a bottom wall 66 and a sidewall 68. A wash drum or basket 70 is rotatably mounted within tub 64. In particular, basket 70 is rotatable about a central axis, which may, when properly balanced and positioned, e.g., as in the example embodiment illustrated, be a vertical axis that is parallel to or generally parallel to the vertical direction V. Thus, washing machine appliance is generally referred to as a vertical axis washing machine appliance or a top load washing machine appliance. Basket 70 defines a wash chamber 73 for receipt of articles for washing and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g., water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e., sprayed or poured) into the tub 64.

Various valves may regulate the flow of fluid through nozzle 72. For example, a flow regulator may be provided to control a flow of hot or cold water into the wash chamber of washing machine appliance 50. For the example embodiment depicted, the flow regulator includes a hot water valve 74 and a cold water valve 75. The hot and cold water valves 74, 75 are used to flow hot water and cold water, respectively, therethrough. Each valve 74, 75 can selectively adjust between a closed position to terminate or obstruct the flow of fluid therethrough to nozzle 72 and an open position to permit the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial or municipal water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, liquid fabric softener, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the example embodiment depicted, nozzle 72 is a separate downstream component from dispenser 84. In other example embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other example embodiments, the washing machine appliance 50 may not include a dispenser, in which case a user may add one or more wash additives directly to wash chamber 73. A pump assembly 90 (shown schematically in FIG. 2) is located beneath tub 64 and basket 70 for gravity-assisted flow to drain tub 64.

An agitation element 92 may be oriented to rotate about the rotation axis A (e.g., parallel to the vertical direction V). Generally, agitation element 92 includes an impeller base 120 and extended post 130. The agitation element 92 depicted is positioned within the basket 70 to impart motion to the articles and liquid in the chamber 73 of the basket 70. More particularly, the agitation element 92 depicted is provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70.

In optional example embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a first temperature sensor 110 may be positioned in the tub 64 as illustrated or, alternatively, may be remotely mounted in another location within the appliance 50. Any suitable temperature sensor 110 may be used as the first temperature sensor 110. The first temperature sensor 110 may generally measure the temperature of contents of the tub 64, such as wash liquid in the tub 64. Additionally, a suitable speed sensor can be connected to the motor 94, such as to the output shaft 98 thereof, to measure speed and indicate operation of the motor 94. Other suitable sensors, such as pressure sensors, water sensors, moisture sensors, etc., may additionally be provided in the washing machine appliance 50. As used herein, "temperature sensor" or the equivalent is intended to refer to any suitable type of temperature measuring system or device positioned at any suitable location for measuring the desired temperature. Thus, for example, first temperature sensor 110 and second temperature sensor 136 may each be any suitable type of temperature sensor, such as a thermistor, a thermocouple, a resistance temperature detector, a semiconductor-based integrated circuit temperature sensors, etc., such as may each be the same type of temperature sensor or may be differing types of temperature sensor. In addition, each temperature sensor 110 and 136 may be positioned at any suitable location and may output a signal, such as a voltage, to a controller that is proportional to and/or indicative of the temperature being measured. Although exemplary positioning of temperature sensors is described herein, it should be appreciated that washing machine appliance 50 may include any other suitable number, type, and position of temperature, humidity, and/or other sensors according to alternative embodiments.

Operation of washing machine appliance 50 is controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, first temperature sensor 110, other suitable sensors, etc. In response to user manipulation of the input selectors 60, controller 100 may operate the various components of washing machine appliance 50 to execute selected machine cycles and features.

While described in the context of specific example embodiments of washing machine appliance 50, using the teachings disclosed herein it will be understood that washing machine appliance 50 is provided by way of example only. Other washing machine appliances having different configurations, different appearances, or different features may also be used with the present subject matter as well.

In addition to the first temperature sensor 110, washing machine appliance 50 may include various other sensors, e.g., a turbidity sensor 132, a conductivity sensor 134, and a second temperature sensor 136. Each of turbidity sensor 132, conductivity sensor 134, and second temperature sensor 136 may be configured for signal communication with controller 100, e.g., sending measurement data or signals to controller 100. In some example embodiments, any two or more of the turbidity sensor 132, conductivity sensor 134, and second temperature sensor 136, in any combination, may be combined into a single sensor to reduce to the total number of sensors in washing machine appliance 50. For example, the turbidity sensor, the conductivity sensor, and the second temperature sensor may all be combined in a single sensor assembly. Further, turbidity sensor 132, conductivity sensor 134, and second temperature sensor 136 may be positioned in tub 64, e.g., on the bottom wall 66 of tub 64.

Figure 3:
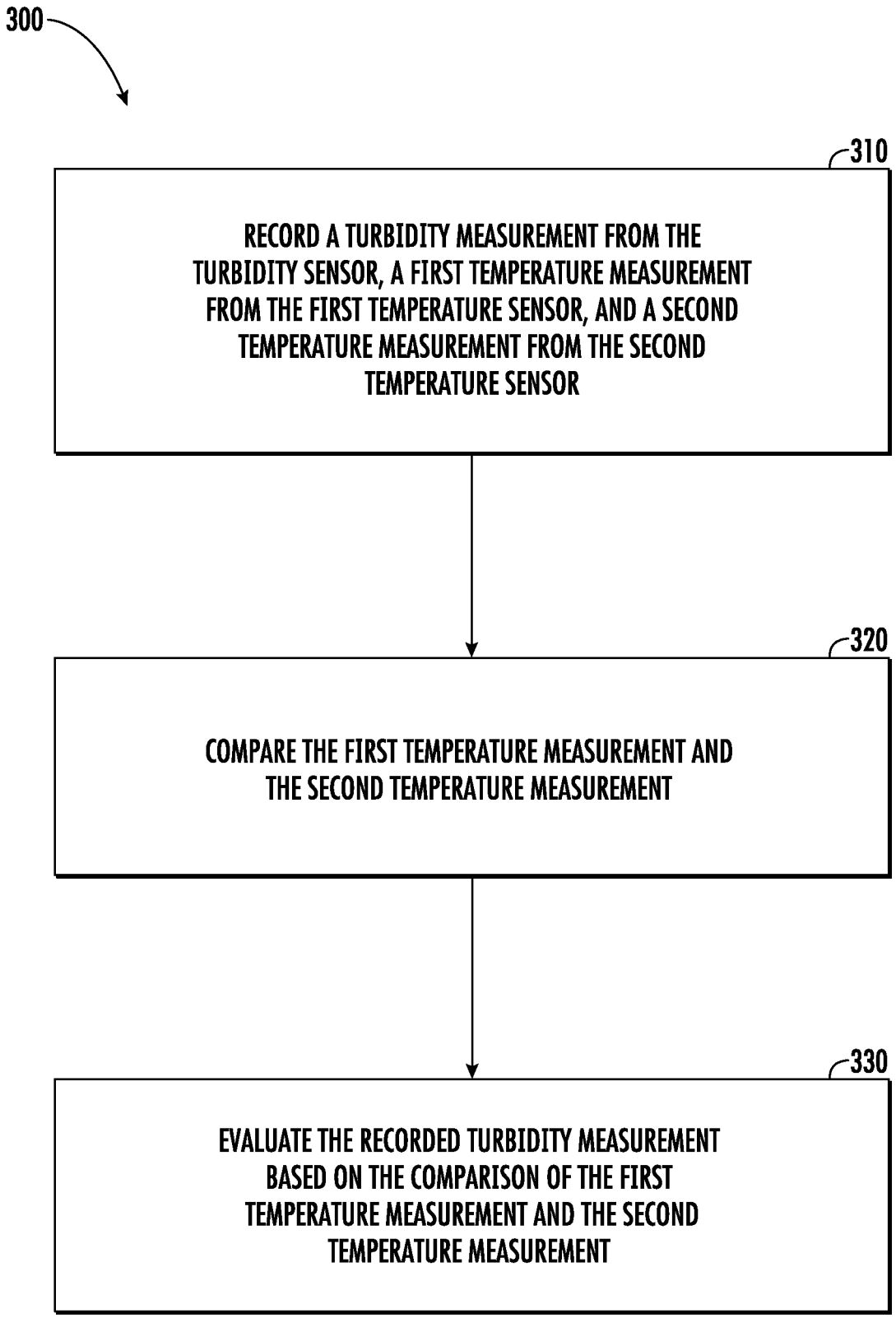
FIG. 3 provides an example method of operating a washing machine appliance such as the example washing machine appliance of FIG. 1.

Embodiments of the present disclosure also include methods of operating a washing machine appliance, such as method 300 illustrated in FIG. 3. Method 300 may be used for operating any suitable washing machine appliance, such as but not limited to washing machine appliance 50. As illustrated at 310, method 300 may include recording a turbidity measurement from the turbidity sensor, a first temperature measurement from the first temperature sensor, and a second temperature measurement from the second temperature sensor. As mentioned, exemplary methods of the present disclosure may be implemented by a controller of the washing machine appliance, such as controller 100. For example, in some embodiments, the measurements at step 310 may be recorded at the controller.

Still referring to FIG. 3, method 300 may further include comparing the first temperature measurement and the second temperature measurement, e.g., as shown at 320 in FIG. 3. As with the recording of the measurements discussed above, the comparison of the first temperature measurement and the second temperature measurement may be performed by the controller, e.g., the controller may be operable to compare the first temperature measurement and the second temperature measurement and/or the controller may be programmed to compare the first temperature measurement and the second temperature measurement. In some exemplary embodiments, comparing the first temperature measurement and the second temperature measurement may include determining whether the second temperature measurement is within a predefined tolerance of the first temperature measurement. For example, the predefined tolerance may be a margin of error which may account for possible deviations between the first temperature measurement and the second temperature measurement due to calibration differences in the temperature sensors, local variations in temperature within the tub, and/or other similar sources of error or variance in the first temperature measurement and the second temperature measurement. In some embodiments, the measurements may be taken at the same time, such as the turbidity measurement from the turbidity sensor, the first temperature measurement from the first temperature sensor, and the second temperature measurement from the second temperature sensor may all be taken and recorded contemporaneously. Thus, the first temperature measurement and the second temperature measurement may be expected to be the same, or about the same when taking account of potential sources of variance such as calibration differences, etc., as mentioned above, when the first temperature measurement and the second temperature measurement are taken contemporaneously. For example, as discussed above, the predefined tolerance may account for such sources of variance.

Method 300 may further include evaluating the recorded turbidity measurement based on the comparison of the first temperature measurement and the second temperature measurement, e.g., as shown at 330 in FIG. 3. As noted above with respect to the other parts of method 300, the evaluation of the recorded turbidity measurement may be performed by the controller. In some exemplary embodiments where the turbidity sensor and the second temperature sensor are combined into a single sensor, an out of tolerance temperature measurement may indicate an issue with each sensor of the combined sensor, such that the turbidity measurement may be evaluated, e.g., a determination may be made whether and to what extent the turbidity measurement is accurate, based on whether the second temperature measurement is within tolerance, e.g., is within the predefined tolerance of the first temperature measurement. Thus, the turbidity sensor and the measurement(s) obtained thereby may be evaluated without a second turbidity sensor to verify or check the turbidity measurement(s) against. Moreover, the turbidity sensor and the measurement(s) obtained thereby may be evaluated for accuracy as opposed to merely determining whether the turbidity sensor is communicating with the controller and transmitting measurements to the controller.

In some embodiments, a user notification may be provided. For example, the user notification may be provided on a user interface, e.g., display 61, of the washing machine appliance, and/or the user notification may be transmitted to and displayed by a remote user interface, such as on a screen of a smartphone, tablet, personal computer, an audible user notification via a smart speaker, among other possible example remote user interfaces. The user notification may be or include a sensor fault. For example, exemplary methods may include, and exemplary washing machine appliance controllers may be operable for, determining that the turbidity measurement is out of tolerance based on the comparison of the first temperature measurement and the second temperature measurement, and providing the user notification in response to determining that the turbidity measurement is out of tolerance.

Additional embodiments which include determining that the turbidity measurement is out of tolerance based on the comparison of the first temperature measurement and the second temperature measurement may also include disabling a cycle selection of the washing machine appliance in response to determining that the turbidity measurement is out of tolerance, e.g., in addition to or instead of providing the user notification. For example, disabling the cycle selection of the washing machine appliance may include disabling selection of an operating cycle of the washing machine appliance, and the turbidity measurement may be an operating parameter of the operating cycle of the washing machine appliance which is disabled. For example, the disabled operating cycle of the washing machine appliance may include taking one or more turbidity measurements during the operating cycle and taking one or more responsive actions based on the turbidity measurement or each turbidity measurement, such as adjusting one or more of water temperature, agitation stroke length, direction, and/or speed, or other similar operating parameters of the washing machine appliance in the operating cycle. Accordingly, when the turbidity sensor is out of tolerance, the results of such operating cycle of the washing machine appliance for which the turbidity measurement is an operating parameter may be undesirable or inaccurate, e.g., where the agitation, etc., of the operating cycle is adjusted based on an inaccurate or out of tolerance turbidity measurement.

As but one possible example of many possible examples, the operating cycle of the washing machine which may be disabled when the turbidity sensor is out of tolerance may be a color keeper cycle. For example, as those of ordinary skill in the art will recognize, laundry articles may be dyed to provide decorative colors and/or designs on the fabric of the articles. When the dye is removed from one or more articles during a washing operation, this may cause the color of the articles to fade or be diminished. Such dye (if any) that is extracted from the article(s) will appear in the wash fluid, e.g., within the tub of the washing machine appliance, during the washing operation, thus resulting in an increase in the turbidity of the wash fluid. In such instances, the color keeper cycle or feature may adjust one or more operating parameters of the washing machine appliance in response to such an increase in the turbidity of the wash fluid, e.g., lowering a temperature of water supplied to the tub of the washing machine appliance. Accordingly, when the turbidity sensor is out of tolerance, the performance of the color keeper cycle or feature may be impaired, such as the water temperature may be lowered excessively, which may result in diminished cleaning efficacy, or the water temperature may not be lowered, which may result in extracting a noticeable and unsatisfactory amount of dye or color from the articles.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a wash tub positioned within the cabinet;

a wash basket rotatably mounted within the wash tub and accessible through an opening in the cabinet;

a first temperature sensor disposed at the wash tub;

a turbidity sensor, a conductivity sensor, and a second temperature sensor disposed in the cabinet;

a controller in signal communication with the first temperature sensor, the turbidity sensor, the conductivity sensor, and the second temperature sensor, the controller configured to:

record a turbidity measurement from the turbidity sensor, a first temperature measurement from the first temperature sensor, and a second temperature measurement from the second temperature sensor;

compare the first temperature measurement and the second temperature measurement;

evaluate the recorded turbidity measurement for accuracy based on the comparison of the first temperature measurement and the second temperature measurement;

determining an operating parameter of the washing machine appliance based on the evaluated accuracy of the turbidity measurement, wherein the operating parameter comprises at least one of an agitation parameter and a water temperature; and performing an operating cycle of the washing machine appliance, wherein performing the operating cycle comprises at least one of rotating an agitator according to the determined operating parameter and flowing a volume of water into the wash tub at a temperature according to the determined operating parameter.

2. The washing machine appliance of claim 1, wherein the controller is configured to contemporaneously record the turbidity measurement from the turbidity sensor, the first temperature measurement from the first temperature sensor, and the second temperature measurement from the second temperature sensor.

3. The washing machine appliance of claim 1, wherein the controller is further configured to determine that the turbidity measurement is out of tolerance based on the comparison of the first temperature measurement and the second temperature measurement, and to provide a user notification in response to determining that the turbidity measurement is out of tolerance, the user notification comprising a sensor fault.

4. The washing machine appliance of claim 1, wherein the performed operating cycle comprises a wash cycle, wherein the controller is further configured to determine that the turbidity measurement is out of tolerance based on the comparison of the first temperature measurement and the second temperature measurement, and to disable a color keeper cycle selection of the washing machine appliance in response to determining that the turbidity measurement is out of tolerance.

5. The washing machine appliance of claim 4, wherein disabling the color keeper cycle selection of the washing machine appliance comprises disabling selection of a color keeper cycle of the washing machine appliance, wherein the turbidity measurement comprises an operating parameter of the color keeper cycle of the washing machine appliance.

6. The washing machine appliance of claim 1, wherein comparing the first temperature measurement and the second temperature measurement comprises determining whether the second temperature measurement is within a predefined tolerance of the first temperature measurement.

7. The washing machine appliance of claim 1, wherein the turbidity sensor, the conductivity sensor, and the second temperature sensor are disposed at a bottom portion of the wash tub.

8. The washing machine appliance of claim 1, wherein the washing machine is a top load washing machine appliance.

9. The washing machine appliance of claim 1, wherein the turbidity sensor, the conductivity sensor, and the second temperature sensor are combined in a single sensor assembly.

10. A method of operating a washing machine appliance, the washing machine appliance comprising a cabinet, a wash tub positioned within the cabinet, a wash basket rotatably mounted within the wash tub and accessible through an opening in the cabinet, a first temperature sensor disposed at the wash tub, a turbidity sensor, a conductivity sensor, and a second temperature sensor disposed in the cabinet, and a controller in signal communication with the first temperature sensor, the turbidity sensor, the conductivity sensor and the second temperature sensor, the method comprising:

recording, at the controller, a turbidity measurement from the turbidity sensor, a first temperature measurement from the first temperature sensor, and a second temperature measurement from the second temperature sensor;

comparing, by the controller, the first temperature measurement and the second temperature measurement;

evaluating, by the controller, the recorded turbidity measurement for accuracy based on the comparison of the first temperature measurement and the second temperature measurement;

determining an operating parameter of the washing machine appliance based on the evaluated accuracy of the turbidity measurement, wherein the operating parameter comprises at least one of an agitation parameter and a water temperature; and performing an operating cycle of the washing machine appliance, wherein performing the operating cycle comprises at least one of rotating an agitator according to the determined operating parameter and flowing a volume of water into the wash tub at a temperature according to the determined operating parameter.

11. The method of claim 10, wherein the turbidity measurement from the turbidity sensor, the first temperature measurement from the first temperature sensor, and the second temperature measurement from the second temperature sensor are recorded contemporaneously.

12. The method of claim 10, further comprising determining that the turbidity measurement is out of tolerance based on the comparison of the first temperature measurement and the second temperature measurement, and providing a user notification in response to determining that the turbidity measurement is out of tolerance, the user notification comprising a sensor fault.

13. The method of claim 10, wherein the performed operating cycle comprises a wash cycle, further comprising determining that the turbidity measurement is out of tolerance based on the comparison of the first temperature measurement and the second temperature measurement, and disabling a color keeper cycle selection of the washing machine appliance in response to determining that the turbidity measurement is out of tolerance.

14. The method of claim 13, wherein disabling the color keeper cycle selection of the washing machine appliance comprises disabling selection of a color keeper cycle of the washing machine appliance, wherein the turbidity measurement comprises an operating parameter of the color keeper cycle of the washing machine appliance.

15. The method of claim 10, wherein comparing the first temperature measurement and the second temperature measurement comprises determining whether the second temperature measurement is within a predefined tolerance of the first temperature measurement.

16. The method of claim 10, wherein the turbidity sensor, the conductivity sensor, and the second temperature sensor are disposed at a bottom portion of the wash tub.

17. The method of claim 10, wherein the washing machine is a top load washing machine appliance.

18. The method of claim 10, wherein the turbidity sensor, the conductivity sensor, and the second temperature sensor are combined in a single sensor assembly.

* * * * *